United States Patent [19]

Morellini

[11] Patent Number: 4,527,367

[45] Date of Patent: Jul. 9, 1985

[54] SPIRAL STAIRCASE

[75] Inventor: Franco Morellini, Rolo, Italy

[73] Assignee: Mobirolo S.p.A., Italy

[21] Appl. No.: 584,475

[22] Filed: Feb. 28, 1984

[30] Foreign Application Priority Data

Mar. 25, 1983 [IT] Italy ..... 28946/83[U]

[51] Int. Cl.[3] ..... E04F 11/00

[52] U.S. Cl. ..... 52/187; 52/726

[58] Field of Search ..... 52/187, 726

[56] References Cited

U.S. PATENT DOCUMENTS

| | | | |
|---|---|---|---|
| 3,713,260 | 1/1973 | Brauckmann | 52/187 |
| 4,378,862 | 4/1983 | Carmel | 52/187 |

FOREIGN PATENT DOCUMENTS

| | | | |
|---|---|---|---|
| 1540609 | 10/1968 | France | 52/187 |
| 1565588 | 10/1969 | France | 52/187 |
| 295840 | 10/1963 | Netherlands | 52/187 |
| 6614192 | 10/1967 | Netherlands | 52/187 |

*Primary Examiner*—Henry E. Raduazo

*Assistant Examiner*—Creighton Smith

*Attorney, Agent, or Firm*—Darby & Darby

[57] ABSTRACT

The invention relates to a spiral staircase which features adjustable rise, and whose structure is obtained by the assembly in reciprocal fashion of identical modular components (1) fitted one on top of the next, each component comprising a cylindrical section (2), to which either a step (4) or the support (3) for a separate tread (4) is fixed direct. Each cylindrical section (2) consists of an upper part (6) and a lower part (7), these coaxially disposed and provided with means for their being paired by screwing, as well as with alignment-surfaces which enable the upper part of each component (1) to insert coaxially into the lower part (7) of any of the other components (1), thus remaining stably associated therewith following assembly and creating a single, solid structure in consequence. The type of pairing envisaged permits adjustment of the stair rise—that is, the distance between two successive treads, and therefore between the two modular components themselves, once assembled.

3 Claims, 2 Drawing Figures

Fig.1
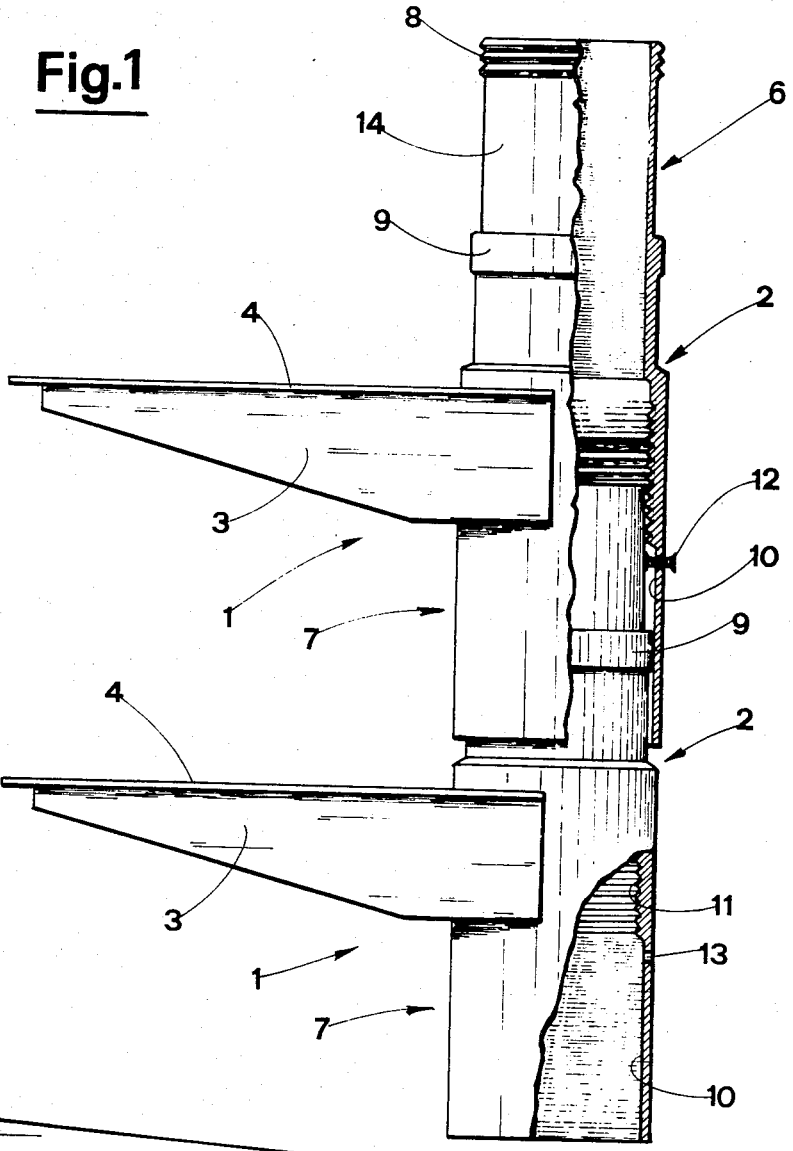
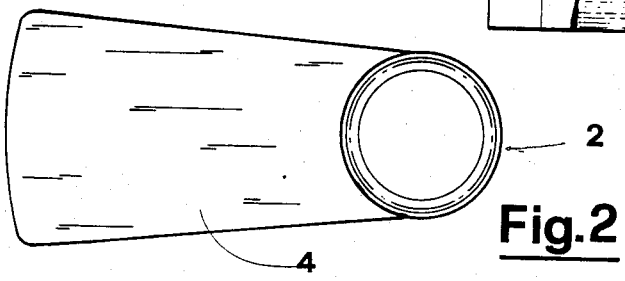
Fig.2

SPIRAL STAIRCASE

BACKGROUND OF THE INVENTION

The invention described herein relates to a spiral staircase, and in particular a spiral staircase featuring adjustable rise.

The invention seeks to set forth a spiral staircase whose overall structure is obtained as a result of assembling a series of modular components—these identical one with the other and fitted-up one on top of the next.

This reciprocal type of assembly is envisaged in such a way as to afford a staircase having a strong spiral structure where no need exists for a center post running from top to bottom in a single piece.

Another object of the invention is that of providing for easy and precise adjustment in the rise-distance of the single stairs—and in the height of the staircase overall, as a result.

It is an advantage of the spiral staircase as described herein that erection is brought about by the straightforward assembly of simple, identical modular components.

SUMMARY OF THE INVENTION

This and other advantages besides will be seen to have been realized by the invention described herein which relates to a spiral staircase having adjustable rise and being characterized in that its erection is brought about by the assembly of modular components in reciprocal fashion one on top of the next; each said component comprising a cylindrical section to whose outer surface a step, or the support for a step-tread, is fixed direct; each said cylindrical section exhibiting an upper part and a lower part, both cylindrical in shape and coaxial one with the other; said upper part comprising an externally-threaded stretch at its topmost end and a coaxially-disposed outer cylindrical stretch of greater diameter set at a given distance therebelow, the latter serving to center and align said upper part for the purposes of assembly;

said lower part being tubular and comprising an internally threaded stretch at its topmost end such as will mate with the externally-threaded stretch at the topmost end of the cylindrical section of another modular component, and an internal cylindrical stretch located below and coaxial with respect to said internally-threaded stretch, which will fit exactly over and slide back and forth axially in reciprocal fashion with the outer cylindrical alignment-stretch aforementioned offered by the upper part of the cylindrical section of another modular component;

there being means by which to lock said modular components thus assembled one to the next in the position desired.

BRIEF DESCRIPTION OF THE DRAWINGS

Further features and advantages of the invention will emerge more clearly from the detailed description of a preferred embodiment which follows, this illustrated as a purely unlimitative example with the aid of the accompanying drawings, in which:

FIG. 1 shows a side view in vertical elevation of two reciprocally-assembled modular components making up the staircase, seen in cutaway; FIG. 2 is the plan from above on smaller scale of one of the two modular components in FIG. 1.

DESCRIPTION OF THE PREFERRED EMBODIMENT

With reference to the drawings, 1 denotes the single modular component having a cylindrical section 2 to whose outer surface a support, or bracket 3 is cantilevered; 4 denotes a tread fitted to this same support 3.

Modular components 1 thus embodied are designed for assembly in reciprocal fashion whereby each fits onto the top of the next via the cylindrical sections 2 aforesaid so as to make up a spiral staircase whose center post, or newel, is created by the build-up of said cylindrical sections 2 one on top of the other.

Each cylindrical section 2 exhibits an upper part 6 and a lower part 7, these being tubular, coaxial, and integral one with the other.

The upper part 6 has an externally-threaded stretch 8 at its topmost end, whilst a smooth outer cylindrical stretch 9 located at a set distance below said externally-threaded stretch 8 is incorporated for the purposes of centering and alignment; the diameter of said outer cylindrical stretch 9 being greater than the outer diameter of said externally-threaded stretch 8, and the two stretches 8 and 9 being coaxially-disposed.

The lower tubular part 7 is of greater diameter than said upper part 6 and has an internally-threaded stretch 11 at is topmost end which will mate with the externally-threaded stretch 8 offered by the topmost end of the cylindrical section 2 of another modular component 1. An internal cylindrical stretch 10 located below said internally-threaded stretch 11 is incorporated likewise for centering-and-alignment purposes, and is designed to fit exactly over the outer cylindrical stretch 9 of the cylindrical section 2 of said other modular component 1 when its upper part 6 is offered thereinto, in such a way that stretches 11 and 9 may slide axially one with respect to the other.

A setscrew 12 is provided by means of which to lock two adjoining modular components together in the desired position, said setscrew 12 turning in a threaded through-hole 13 located radially in the lower part 7 of said cylindrical section 2 such, that when tightened from the outside, it urges against the outer surface 14 of the upper part 6 of the cylindrical section of whichever modular component 1 happens to be inserted in the lower part 7 in question. Thus, the assembly of any two adjoining modular components 1 is achieved simply by inserting the upper part 6 of one into the lower part 7 of the other and causing their respective externally and internally threaded stretches 8 and 11 to engage; the precise centering of said adjoining components both during and following assembly, being assured by the fit between respective cylindrical surfaces 9 and 10 which, whilst exact, nonetheless permits the degree of axial slide necessary to a smooth pairing between the two modular components.

This screw-type assembly between successive modular components 1 fitted one onto the next is fundamental in providing extremely easy and precise adjustment of the rise from step to step—and by definition, of the overall height of the staircase proper when actually erected in situ.

Locking of one component against the next is then rendered equally simple, since all that is required is tightening of the setscrew 12 from outside so as to turn in its threaded hole 13, thus making contact with and urging against the outer surface 14 offered by upper part 6 of the modular component 1 beneath.

Numerous modifications of a practical nature may be made to constructive details of the invention whilst in no way straying from within the bounds of protection afforded thereto by claims appended.

What is claimed:

1. Spiral staircase featuring adjustable rise, characterized in that it is created by the assembly in reciprocal fashion of single modular components (1) fitted-up one on top of the next;

each said modular component (1) comprising a cylindrical section (2) to whose outer surface a step (4) or the support (3) for a step-tread (4) is fixed direct, each said cylindrical section exhibiting an upper part (6) and a lower part (7), both cylindrical in shape and coaxial one with the other;

said upper part (6) comprising an externally-threaded stretch (8) at its topmost end and a coaxially-disposed outer cylindrical stretch (9) of greater diameter set at a given distance below said threaded stretch (8) and serving to center and align said upper part for the purposes of assembly;

said lower part (7) being tubular and comprising an internally-threaded stretch (11) at its topmost end such as will mate with said externally-threaded stretch (8) offered by the topmost end of the cylindrical section (2) of another modular component (1); and an internal cylindrical stretch (10) for centering and alignment purposes located below said internally-threaded stretch (11) and designed to fit exactly over and slide back and forth axially in reciprocal fashion with the outer cylindrical newel-alignment stretch (9) offered by the upper part of the cylindrical section (2) of another modular component (1);

there being means by which to lock said modular components (1) thus assembled one to the next in the position desired.

2. Staircase as in the preceding claim 1 characterized in that said means comprise at least one setscrew (12) turned from the outside and mating with a threaded through-hole (13) located radially in the lower part (7) of each modular component's cylindrical section (2) at a level coinciding with the internal cylindrical newel-alignment surface (10) and marginally below its relative internally-threaded stretch (11).

3. Staircase as in preceding claim 1 characterized in that each cylindrical section (2) is hollow, being created by the integral association of an upper (6) and lower part (7) both of which are tubular.

* * * * *